United States Patent [19]

Hughes

[11] Patent Number: 4,768,438

[45] Date of Patent: Sep. 6, 1988

[54] INK AGITATORS

[76] Inventor: Ken D. Hughes, P.O. Box 361, Eden, N.C. 27288

[21] Appl. No.: 849,789

[22] Filed: Apr. 9, 1986

[51] Int. Cl.[4] ..... B41F 1/40

[52] U.S. Cl. ..... 101/363; 101/DIG. 8; 198/619; 310/14; 366/346

[58] Field of Search ..... 310/12, 14; 198/619; 101/350, 363, 364, DIG. 14, DIG. 8, 348, 349; 366/346

[56] References Cited

U.S. PATENT DOCUMENTS

| | | | |
|---|---|---|---|
| 3,712,472 | 1/1973 | Elliott | 198/619 |
| 3,848,529 | 11/1974 | Gegenheimer | 101/363 |
| 3,882,791 | 5/1975 | Youngscap | 198/619 |
| 4,457,423 | 7/1984 | Stoll | 198/619 |
| 4,589,337 | 5/1986 | Hardin | 101/363 |
| 4,589,541 | 5/1986 | Lisec | 198/619 |

FOREIGN PATENT DOCUMENTS

| | | | |
|---|---|---|---|
| 1292118 | 4/1969 | Fed. Rep. of Germany | 101/123 |
| 3306805 | 9/1984 | Fed. Rep. of Germany MV | 101/382 |
| 2490999 | 4/1982 | France | 101/123 |
| 878094 | 9/1961 | United Kingdom | 101/123 |
| 972630 | 11/1982 | U.S.S.R. | 310/12 |

*Primary Examiner*—Clyde I. Coughenour

*Attorney, Agent, or Firm*—Charles R. Rhodes; Judith E. Garmon

[57] ABSTRACT

A rodless linear drive cylinder includes a cylindrical hollow tube, sealed at the ends and containing a pneumatically driven piston. The drive cylinder is so mounted to extend across the ink fountain of a printing machine and includes an ink agitator suspended therefrom into the ink fountain. The agitator is magnetically coupled to the drive piston of the linear drive cylinder.

8 Claims, 4 Drawing Sheets

FIG. 3
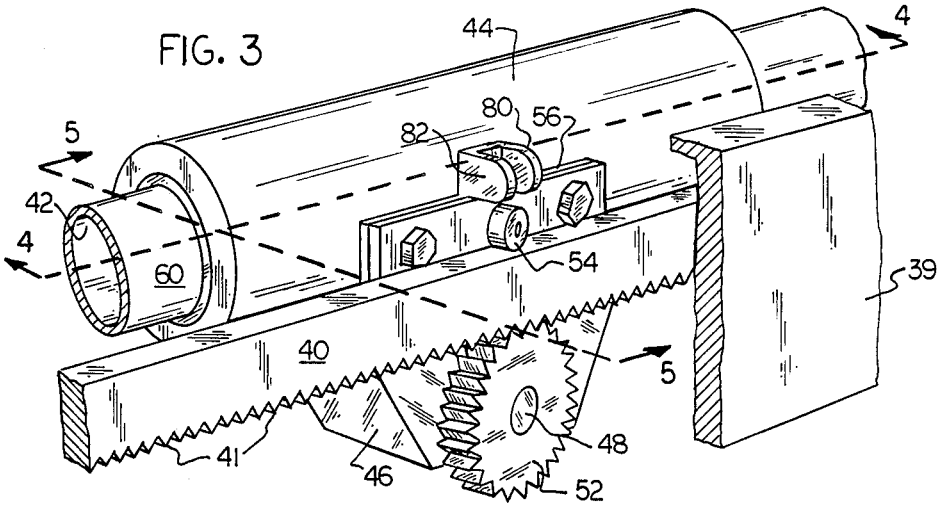
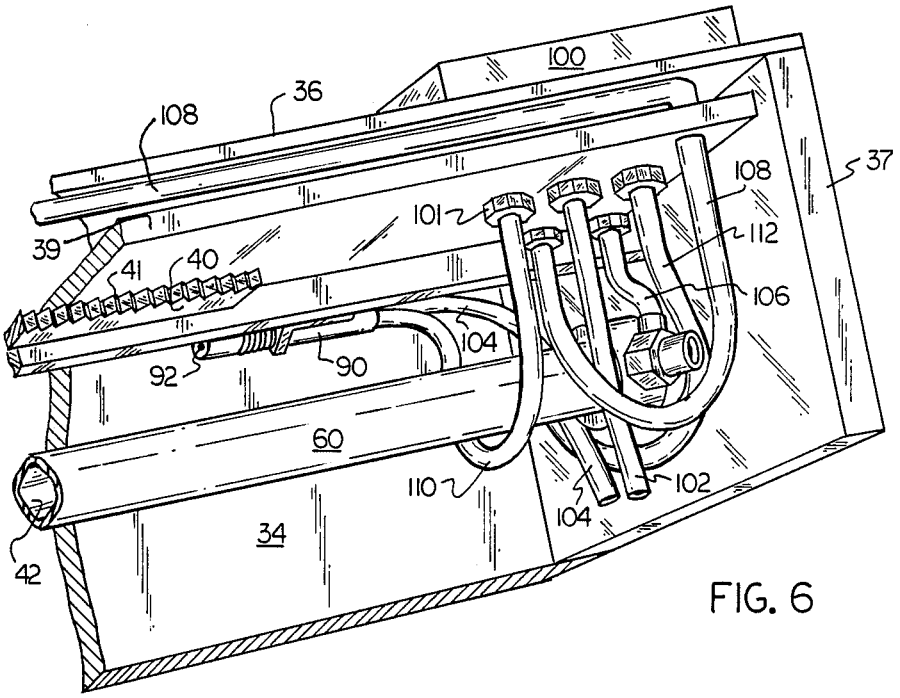
FIG. 6

INK AGITATORS

BACKGROUND AND SUMMARY OF THE PRESENT INVENTION

This invention relates to improvements in ink agitators for printing machines, and more specifically to ink agitators which are driven back and forth across the ink fountain to homogenize the ink therein.

Conventional printing machines include an ink fountain or reservoir extending across the width of the machine at a position near the top thereof. The ink fountain is periodically or continuously supplied with ink. The ink is eventually removed from the ink fountain by a fountain roll, then transferred by means of one or more duct rolls, transfer rolls, and vibrating rolls to a printing plate cylinder or blanket cylinder which actually transfers the ink onto the media for which it is intended. Different inks are formed of different chemical compositions. Some chemical compositions react with air in such a manner as to adversely affect the subsequent printing operation. For example, some inks will form a surface skin unless the ink is continuously stirred or mixed. Other inks must be continuously stirred in order to maintain the color consistency. This is referred to as keeping the ink "open."

It has therefore become recognized in the printing industry that it is highly desirable to maintain the ink in the ink fountain homogenized by agitation or stirring. Early ink agitators were driven by means of a motor attached to the frame of the printing machine and coupled to the stirring device or agitator by some type of transmission means such as belts, chains or the like. While such arrangement is preferable to manual stirring or no agitation at all, it is relatively ineffective as far as being completely satisfactory is concerned. The ink tends to collect on the chains, belts, and the like causing continuous maintenance problems. Further, such equipment is cumbersome and expensive. A further advance is shown in U.S. Pat. No. 4,108,068, issued Aug. 22, 1978 in which a self-driven mobile assembly is supported parallel to the longitudinal axis of the ink fountain on a beam extending thereacross. While such ink agitators offered some improvement, they are still not completely satisfactory of down time and excessive maintenance problems.

A further approach which eliminates electric motors and chain drives utilizes linear drive cylinders such as hydraulic or pneumatic cylinders. However, conventional linear drive cylinders are not applicable in this situation, because here there is not sufficient room to mount the drive cylinder and still allow the piston rod to traverse the entire width of the printing machine. Rodless, linear drive cylinders in which a pneumatic piston within the sealed hollow tube is moved backwardly and forwardly by air or fluid are appropriate. However, as applied to ink agitators, the only known use of such types of rodless, linear drive cylinders are those in which the carriage carrying the ink agitator is connected to the piston within a hollow tube of special cross-sectional shape by means of a sliding seal along an open side of the cylinder. Such types of ink agitators are manufactured by Grafische Technik GmBH of Augsburg, West Germany, and offered for sale in this country under the trademark "PIAC." The sliding seal carriage is relatively expensive, difficult to maintain, and still suffers from the possibility of ink, oil, grease, and dust leakage into the cylinder.

Therefore, in the present invention, the carriage which carries the agitator is magnetically coupled to the piston of a rodless, linear drive cylinder rather than being mechanically coupled thereto. This approach is considerably less expensive and more effective in that leakage of contaminants into the cylinder is impossible.

Toward this end, a cylindrical hollow tube, sealed at the ends, is mounted to the printing machine to extend longitudinally of the ink fountain. The hollow tube is filled with a working fluid and includes a piston slidably positioned therein for reciprocating movement back and forth within the hollow tube responsive to the flow of the working fluid into the ends thereof. A yoke or carriage surrounds the hollow tube and is magnetically coupled to the piston therein, whereby movement of the piston induces a similar movement of the yoke, even though the yoke and piston are not mechanically attached. Therefore, the carriage is driven back and forth by the piston without any slot in the sealed tube. By such approach, it is impossible for any ink, grease, or dust to leak into the pneumatic tube to create maintenance problems.

An agitator is connected to the carriage and suspended in the fountain whereby movement of the yoke causes movement of the agitator through the ink fountain.

Several further developments serve to improve the appratus and minimize maintenance even further. Such further improvements include a protective housing or cover surrounding, substantially encasing the drive cylinder and carriage on three sides, which housing carries the drive cylinder and is hingedly attached to the sides of the printing machine; a unique bearing and pinion connecting the agitator carriage to a geared rack which ensures constant even mesh of the pinion with the rack throughout the reciprocating movement during operation; means for quickly removing the agitator from the carriage for cleaning purposes; and a housing support bracket so constructed that the entire agitator apparatus is quickly and easily removable from the machine for replacement purposes.

It is therefore one object of the present invention to provide an improved ink agitator which is simple, easily replaceable, and substantially free from maintenance problems.

It is another object of the present invention to provide an ink agitator of the type described which utilizes a rodless, linear drive cylinder in which the agitator carriage is magnetically coupled to the interior drive piston, thus eliminating any opportunity for ink, grease, or dust to leak into the pneumatic cylinder.

Another object of the present invention is to provide an ink agitator of the type described which includes a drive pinion maintained in positive engagement with the teeth of a drive rack by means of a complementary bearing.

Other objects and a fuller understanding of the invention will become apparent from reading the following detailed description of a preferred embodiment along with the accompanying drawings in which:

FIG. 3 is a perspective view of the drive cylinder and adjacent agitator rotating rack, with parts broken away, illustrating the manner in which the carriage is supported on the drive cylinder and adjacent rack by a pinion and bearing, with all parts removed from the housing;

FIG. 6 is a perspective view illustrating one end of the housing and the manner in which the air supply is controlled.

DETAILED DESCRIPTION OF A PREFERRED EMBODIMENT

Figure 1:
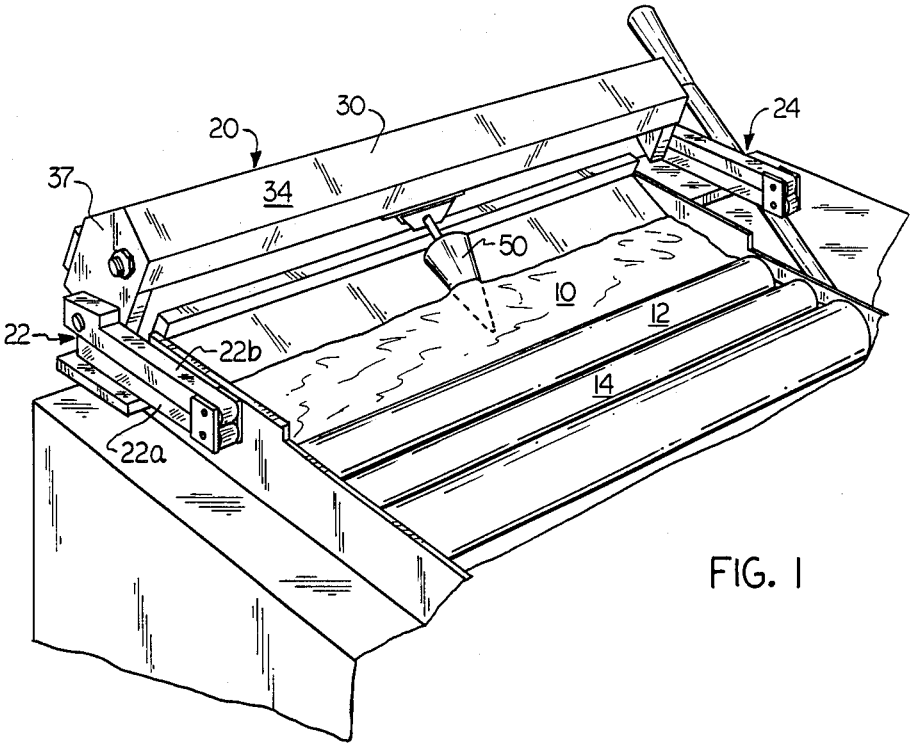
FIG. 1 is a perspective view of the upper portion of a printing machine illustrating the apparatus of the present invention mounted in operative relationship to the ink fountain thereof.
Figure 2:
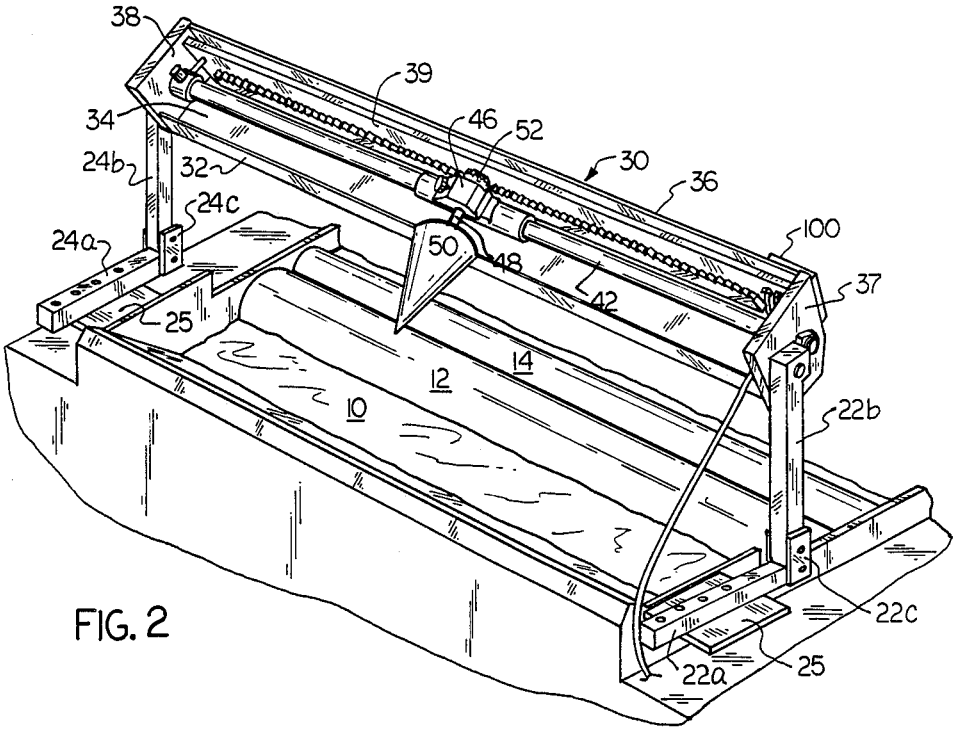
FIG. 2 is a perspective view, also of the upper portion of a printing machine, in which the agitator apparatus of the present invention is elevated to its non-operative, adjustment or maintenance position.

Turning now to the drawings, and particularly to FIGS. 1 and 2, there is illustrated the upper portion of a printing machine P. An ink fountain or reservoir 10 contains a supply of ink which is either manually fed or continuously fed. A fountain roll 12 rotates in or adjacent to the edge of ink fountain 10 to form an ink film thereon. The duct roll 14 is reciprocated between a position in engagement with the fountain roll 12 and in a position with one of the lower vibrating rolls (not shown). The ink is then processed down through a plurality of vibrating and transfer rolls to the plate cylinder from whence it is applied to the media for which it is intended. The transfer of ink through the transfer and vibrating rolls is not germaine to the present invention, and therefore does not need to be described further.

Rather, the present invention is concerned with the continuous agitation of the ink in the ink fountain 10. Toward this end there is provided an agitating apparatus 20 which, in general, includes a pair of brackets 22,24 between which is connected a housing 30. The agitator 50 is suspended from the housing, as will be hereinafter described, and is continuously immersed or at least partially submersed in the ink fountain 10. During operation the agitator 50 is moved to and fro across the ink fountain while the agitator 50 is continuously rotated to stir the ink. Thus the agitator is both reciprocated and rotated.

In FIG. 2 it can be seen that the brackets 22,24 include a pair of spaced horizontally extending arms 22*a*, 24*a* secured by fasteners (not shown) to brackets 25 secured on the printing machine P at opposite sides of the ink fountain 10. A second pair of arms 22*b*, 24*b* are hingedly connected to one end of the aforesaid support arms 22*a*, 24*a* by hinge means 22*c*, 24*c*. The free ends of arms 22*b*, 24*b* are then secured to and support the opposite ends of housing 30. So arranged, the agitating apparatus 20 may be lowered to the operative position illustrated in FIG. 1 or raised to the inspection or maintenance position in FIG. 2. In the lower operative position (FIG. 1) the agitator is immersed (or partially immersed) in the ink fountain 10 while in the inspection or maintenance position (FIG. 2) the agitator 50 is lifted out of the ink fountain, and the underside of the housing is accessible to an operator.

Further, looking at FIGS. 1 and 2 the housing 30 includes a front wall 32, a top wall 34, and a rear wall 36 all connected between the spaced end walls 37,38 thereof. A mounting plate 39 is secured between end walls 37,38 in spaced parallel relation to rear wall 36. Mounting plate 39 includes a rack 40 secured to the front surface thereof extending substantially the entire length thereof. Rack 40 includes a smooth upper surface and a toothed or geared lower surface.

A rodless linear drive cylinder 42 is also secured between end walls 37,38 and extends in adjacent parallel relation to rack 40. The configuration of rodless, linear drive cylinder 42 will be described more fully hereinafter with relation to FIG. 4.

A carriage 44 surrounds rod 42 and is magnetically coupled thereto as will be hereinafter described. A mounting block 46, releasably attached to carriage 42 carries the agitator cone at an angle perpendicular to the longitudinal dimension of the rodles, linear drive rod 42. For purposes of connecting agitator 50 to support block 46 an agitator support rod 48, carrying agitator 50, extends through block 46 in rotatable bearing relationship thereto. A toothed wheel, hereinafter referred to as pinion 52, is mounted on the free end of agitator rod 48 in meshed engagement with the teeth on the underside of rack 40.

Referring now to FIG. 3 there is illustrated in an enlarged view the yoke or carrier 44 surrounding and mounted on the rodless, linear drive cylinder 42. For purpose of illustration, the linear drive cylinder is cut away at both ends so that only an intermediate portion is illustrated. As shown in FIG. 3 the upper portion of yoke 44 is generally circular in crosssection, while the bottom portion is rectangular and includes a bracket 45 (FIG. 4) which releasably mounts the carriage support block 46. As previously indicated the free end of agitator support shaft 48 carries the pinion 52. The drive cylinder 42 and rack 40 are so arranged with respect to each other that the pinion 52 tends to mesh with the teeth 41 on the lower side of gear rack 40. In order tO maintain the pinion 52 in closely meshed engagement with teeth 41, a bearing 54 carried by an upstanding wall 56 of bracket 45 rides along the upper surface of rack 40. The distance between bearing 54 and pinion 52 is substantially the same as the width of rack 40 with the agitator support block 46 being securely mounted within the bracket 45 by a retaining screw 47 and the bearing 54 being mounted on an upstanding wall 56 of bracket 45. Therefore, pinion 52 is not permitted to disengage from the teeth 41 of rack 40 unless and until support block 46 is removed from the bracket 45. The retaining screw 47 (FIG. 4) permits tightening of support block 46 within bracket 45, so that the meshing "grip" may be adjusted.

Figure 4:
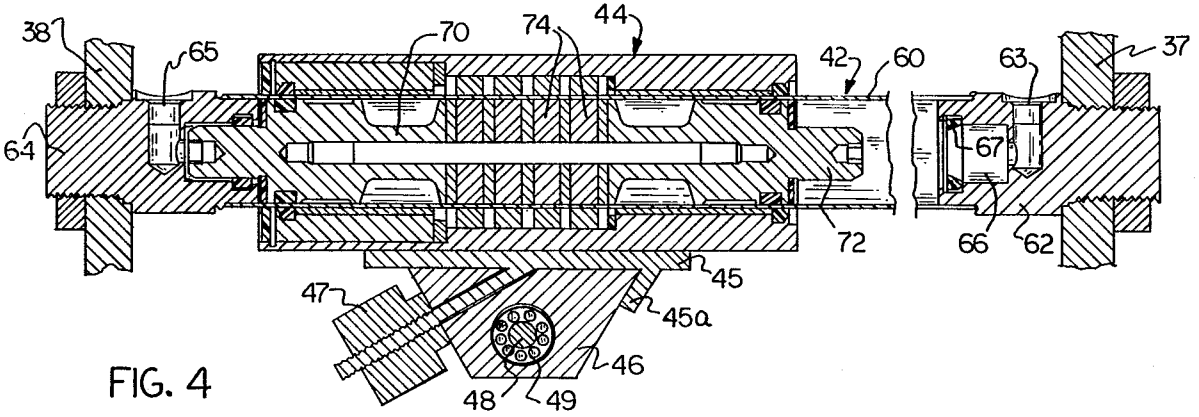
FIG. 4 is a sectional view of the carriage and drive cylinder taken substantially along lines 4—4 in FIG. 3.
Figure 7:
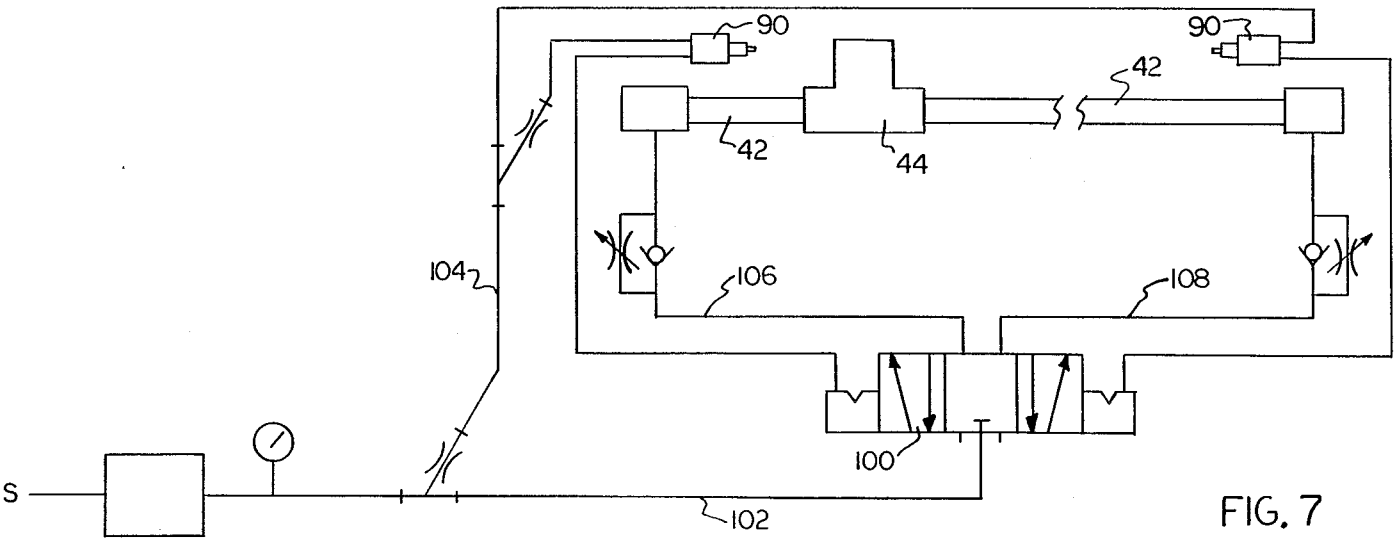
FIG. 7 is a pneumatic schematic of the apparatus of the present invention.
Figure 5:
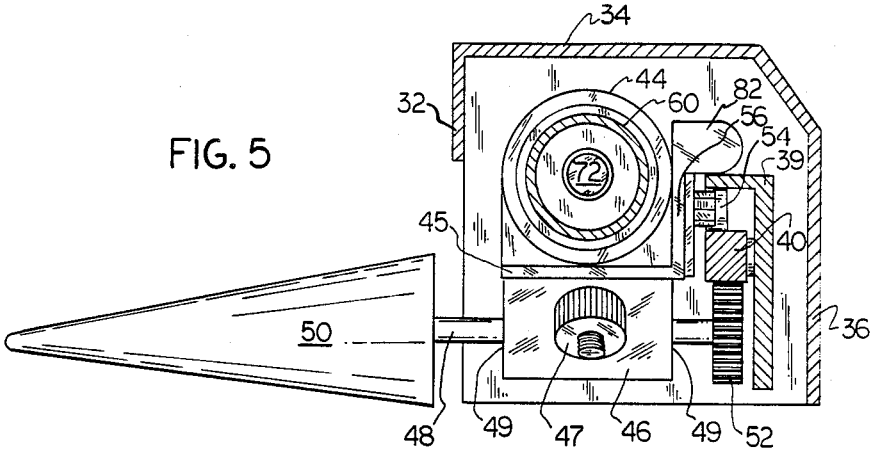
FIG. 5 is a sectional view of the drive cylinder, carriage, and agitator rotating rack taken substantially along lines 5—5 in FIG. 3.

Turning now to FIGS. 4 and 5 there is illustrated cross-sectional views of the rodless, linear drive cylinder 42 and the yoke 44. The drive tube 42 is formed of the hollow, preferably stainless steel tubular barrel 60 having the ends thereof closed by end caps 62,64. The end caps are in turn mounted to end walls 37,38 of housing 30 as previously described. Each of end caps 62,64 include an air or fluid port 63,65 for the introduction or exhaust of air or fluid therefrom during the operation of the drive cylinder. The ports 63,65 each communicate with a receiving chamber 66 into which the end portions of the piston are received during movement back and forth at the extreme end portions of the traverse cycle. During operation the piston may not actually travel the entire length of its potential stroke, however, this is immaterial to the operation of the drive cylinder 42. Receiving chambers 66 also include an end cushioning seal 67 in a peripheral groove therein to absorb the shock of the piston as it reaches the extremity of its stroke.

The piston 70 is a generally cylindrical member having protruding end portions 72 extending axially from each end thereof. Appropriate macnines and seals are provided in the exterior periphery of piston 70 to ensure a good reciprocating movement of the piston within hollow tube 60 without permitting leakage of air in either direction past the piston 70. One or more disc shaped or annular shaped permanent magnetic members 74 are provided in the medial portion of piston 70. The aforesaid piston magnets produce a magnetic field extending through the wall of hollow tube 60 tending to attract oppositely polarized magnetic members positioned adjacent the hollow tube in the yoke 44.

As previously stated yoke 44 surrounds the cylinder 42 in sliding, magnetically coupled relation thereto. Toward this end the interior of the yoke 44 includes a passage the same size or slightly larger as the outer diameter of hollow tube 60. The inner wall of the passageway in yoke 44 includes appropriate bushings and seals to ensure reliable, prolonged sliding movement therealong. Mounted in the interior wall of yoke 44 are a plurality of annular yoke magnets 76 which cooperate with the piston magnets 74 to magnetically couple the yoke to the hollow tube 60. Thus, as the piston 70 is reciprocated back and forth by the introduction and removal of air at either endnof the hollow tube 60, the yoke 44 is caused to move in the same path at the same speed. The magnetic coupling force between the yoke 44 and the drive cylinder 42 is quite strong (at least 100 pounds).

The actuator support block, as illustrated in FIG. 4, has a trapezoidal cross section and the bracket 45, at one end, includes an upturned angular lip 45*a* that retains one end of the support block 46. The other end of support block 46 is rerained by a retaining screw 47. So arranged, the agitator support block may be easily removable for cleaning and replacement. The support block 46 also includes a rather large central opening therethrough containing a bushing or sleeve 49 therein through which the agitator support shaft 48 extends in rotatable relation. Thus as the yoke 44 moves back and forth across the drive cylinder 42, the rotation of pinion 52 is imparted to agitator shaft 48 which rotates within bearing 49 and causes a resulting rotation of the agitator 50.

Turning now to FIG. 6, there is illustrated in perspective the underside of housing 30 adjacent one end thereof where the pneumatic control system is located. A pneumatically operated limit switch 90 having an actuator pin 92 is positioned on the mounting plate 39 adjacent the end of rack 40. So positioned a tab 82 on the wall of bracket 56 engages the actuator arm 92 as the piston stroke of the drive cylinder 42 approaches one extent. A second tab 80 on the opposite side of bracket wall 56 engages a similar limit switch 90 (not shown) at the opposite end of rack 40 adjacent the end of the piston stroke in the opposite direction. A double pilot valve 100 is mounted atop the support plate 39, and a plurality of couplings 101 provide communication between the piiot valve 100 through a support plate 39 to a plurality of air lines 102,104,106,108, and 110.

Incoming air from a source of compressed air enters the pilot valve in the control system through conduit 102. A branch 104 in the conduit carries control air for the pneumatic limit switches 90 at each end of the housing 30. Conduit 106 connects the valven 100 with one end of the drive cylinder 42 and conduit 108 connects pilot valve 100 with the opposite or far end of drive cylinder 42. Finally, conduit 110 connects valve 100 with one limit switch 90 and conduit 112 conduits the pilot valve 100 with the limit switch 90 at the opposite end of housing 30.

In operation, the carriage 42 is reciprocated back and forth across the ink fountain as air is alternately introduced to opposite ends of cylinder 42. As the carriage 42 approaches one end of the rack 40, the activating pin 92 of the adjacent limit switch 90 is engaged which operates pilot valve 100 to shut off the flow of air to one end of drive cylinder and activate air to the opposite end of drive cylinder 42. As the piston moves in the opposite direction, the air in front of the piston is exhausted through a one-way valve at the end of the drive cylinder 42 or in the pilot valve 100. As the carriage 44 reciprocates back and forth along the rodless, drive cylinder 42, engagement of the pinion 52 with rack 40 causes the agitator to revolve in the ink fountain. When access to the agitator is required, the housing is hinged upwardly about hinges 22*c* and 24*c* to provide operator visual and operative access thereto. Since the drive cylinder 42 is sealed, the environment will not tend to deteriorate the drive cylinder and ink, oil, grease. and dust cannot leak into the interior of the drive cylinder. The resulting agitator is substantially maintenance free.

While a preferred embodiment of the invention has been described in detail hereinabove, ir is obvious that various changes and modifications might be made without departing from the scope of the invention which is set forth in the following claims.

What is claimed is:

1. An agitating apparatus for the ink fountains of a printing machine comprising:

(a) a cylindrical hollow tube sealed at each end, mounted to said machine and extending longitudinally of and spaced above said ink fountain, said hollow tube containing a working fluid therein and fluid conduits connecting each end of said working tube with a pressurized source of said fluid;

(b) valve means connecting each end of said hollow sealed tube with said pressurized source of fluid for selectively introducing and withdrawing said working fluid to and from each end thereof;

(c) a rodless and cableless piston slidably positioned in said tube for free reciprocating movement therein responsive to the flow of said working fluid;

(d) a carriage having an opening therethrough and surrounding said hollow tube;

(e) means associated with said carriage for preventing rotation of said carriage with respect to said hollow tube;

(f) magnetic means for coupling said carriage to said piston whereby movement of said piston induces a similar movement of said carriage even though the carriage and piston are not mechanically attached;

(g) an agitator means carried by said carriage and suspended in said fountain whereby movement of said carriage causes reciprocal movement of said agitator means through said ink fountain; and (h) means for rotating said agitator means during said reciprocal movement thereof.

2. The agitating apparatus according to claim 1 wherein said magnetic means comprises:

(a) at least one disc or annular shaped permanent piston magnet extending around the periphery of said piston;

(b) at least one annular shaped, permanent yoke magnet carried by said yoke adjacent the opening therethrough and surrounding said tube;

(c) the polarization of said piston magnet and said carriage magnet being such that said piston and carriage are so coupled that movement of said piston, responsive to the introduction of working fluid to said tube at either end causes corresponding movement of said carriage.

3. The agitating apparatus according to claim 1 and further including an agitator support block releasably mounted on said carriage and having an opening therein perpendicular to the longitudinal axis of said rodless, linear drive cylinder, whereby said support block is moved back and forth across said ink fountain with said carriage.

4. The agitating apparatus according to claim 3 and further including an ink agitator cone having an axis coincidental with the axis of the opening in said support block opening and including an agitator support shaft extending therefrom and through the opening in said support block in rotatable bearing relation thereto, said agitator support shaft having a toothed wheel or pinion attached to the free end thereof.

5. The agitating apparatus according to claim 1 and further including a pair of spaced bracket means on either side of said printing machine at opposite ends of said ink fountain, each of said bracket means comprising a pair of support arms hinged together at one end, the free end of one arm being secured to said machine and the free end of the other arm being attached to one end of a housing, said housing comprising front, rear, top, end walls and an open bottom, each of said housing end walls being connected to said bracket arm means with said front, rear, and top walls extending across the area above said fountain.

6. The agitating apparatus according to claim 1 and further including an elongated rack having a plurality of transverse teeth along the lower edge thereof and a smooth upper edge, said rack being secured to a support bracket extending within and along the length of said housing, the teeth on said pinion meshing with said rack in such a manner as to induce a rotation of said agitator cone responsive to linear movement of said yoke along said tube.

7. The agitating apparatus according to claim 1 and further including at least one rotatable support wheel attached to and extending transversely of said carriage, the surface of said support wheel resting on the upper smooth edge of said elongated rack to ensure meshing engagement of said pinion with the teeth of said rack.

8. An agitating apparatus for the ink fountain of a printing machine comprising:

(a) a pair of spaced bracket means on either side of said machine at opposite ends of said ink fountain, each of said bracket means comprising a pair of support arms hinged together at one end, the free end of one arm being secured to said machine and the free end of the other arm being attached to one end of a housing;

(b) said housing including front, rear, top, end walls and an open bottom, each of said housing end walls being connected to said bracket means with said front, rear, and top walls extending across the area above said ink fountain.

(c) a rodless, linear drive cylinder mounted within said housing between said end walls across said ink fountain, said cylinder comprising a cylindrical hollow tube sealed at each end and containing a working fluid therein and fluid conduits connecting each end of said working tube with a pressurized source of working fluid, a rodless piston located in said tube and having associated therewith at least one disc or annular permanent piston magnet extending around the periphery of said piston, a carriage or carriage containing at least one annular shaped permanent carriage magnet surrounding said tube, a valve means connecting each end of said hollow sealed tube with said source of pressurized working fluid for selectively introducing and withdrawing said working fluid to and from each end thereof, the polarization of said piston magnet and said carriage magnet being such that said piston and carriage are so coupled that movement of said piston, responsive to the introduction of fluid to said tube at either end causes corresponding movement of said carriage;

(d) an agitator support block releasably mounted on said yoke and having an opening therein perpendicular to the longtiudinal axis of said rodless, linear drive cylinder whereby said support block is moved back and forth across said ink fountain with said carriage;

(e) an ink agitator cone having an axis coincidental with the axis of the opening in said support block opening and including an agitator support shaft extending therefrom and through the opening in said support block in rotatable bearing relation thereto, said agitator support shaft having a toothed wheel or pinion attached to the free end thereof;

(f) an elongated rack having a plurality of transverse teeth along the lower edge thereof and a smooth upper edge, said rack being secured to a support bracket mounted in said housing and extending along the length thereof, the teeth on said toothed wheel meshing witn said rack in such a manner as to induce a rotation of said agitator cone responsive to linear movement of said carriage along said tooth; and (g) at least one rotatable support wheel extending transversely to said carriage, the surface of said support wheel resting on the upper smooth edge of said elongated rack to ensure meshing engagement of the teeth of said pinion with the reeth of said rack.

* * * * *